United States Patent [19]

Frank

[11] 4,034,677

[45] July 12, 1977

[54] RAILROAD CLASSIFICATION YARDS

[75] Inventor: Earl E. Frank, Tallman, N.Y.

[73] Assignee: Abex Corporation, New York, N.Y.

[21] Appl. No.: 615,378

[22] Filed: Sept. 22, 1975

[51] Int. Cl.[2] ..... B61B 1/00

[52] U.S. Cl. ..... 104/26 R; 104/162; 104/252; 246/182 BH

[58] Field of Search ..... 104/26 R, 26 A, 26 B, 104/88, 162, 249, 252, 253; 246/182 BH, 182 AA, 182 AB

[56] References Cited

U.S. PATENT DOCUMENTS

| | | | |
|---|---|---|---|
| 3,251,991 | 5/1966 | Coley | 104/26 A X |
| 3,799,064 | 3/1974 | Kikuchi | 104/252 X |

*Primary Examiner*—Robert J. Spar
*Assistant Examiner*—George F. Abraham
*Attorney, Agent, or Firm*—Kinzer, Plyer, Dorn & McEachran

[57] ABSTRACT

Two car retarders and an interposed means to push the cars are installed on a storage track. The upstream retarder slows the cars. The downstream retarder collects the cars released from the upstream retarder. The cars, coupled as a block, are pushed from the downstream retarder.

14 Claims, 1 Drawing Figure

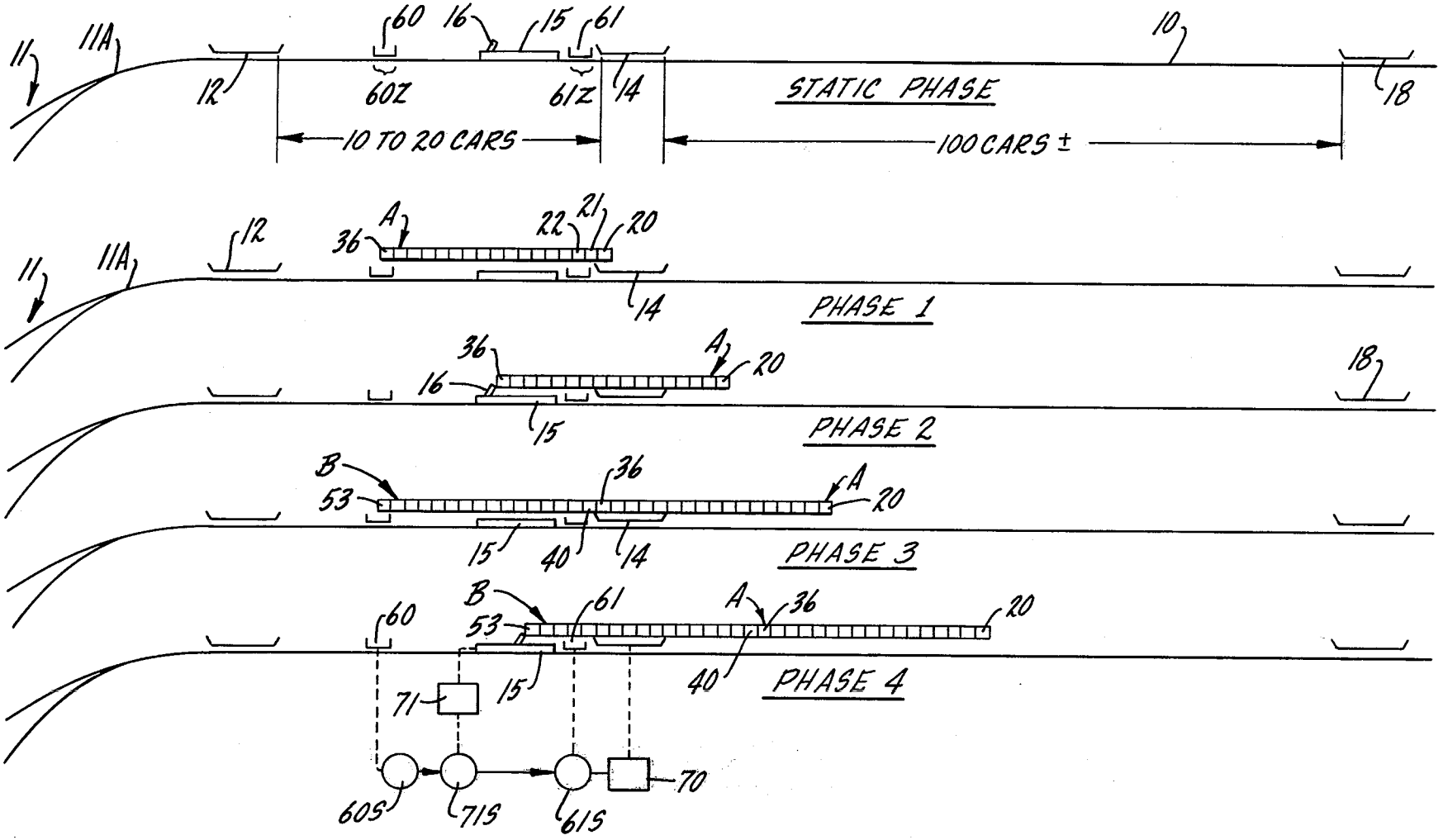
STATIC PHASE
100 CARS ±
10 TO 20 CARS
PHASE 1
PHASE 2
PHASE 3
PHASE 4

RAILROAD CLASSIFICATION YARDS

This invention relates to a method for assuring safe coupling speeds in the course of classifying railroad cars in a classification yard.

In a railroad classification yard, cars in a train are uncoupled and roll down the grade of a so-called hump, one by one. Downstream of the hump, the cars are diverted to different storage tracks. As the cars roll down the storage track, the plan is that the inertia of each car will be just adequate to couple it to the one ahead which has come to a stop on the classification track. In this manner a new train is originated according to the ultimate destination of the assembled cars.

It is customary to install retarders in the classification yard in order to slow the cars to a safe coupling speed. For example it is customary to install a master retarder on the downgrade of the hump. This retarder is used to slow the cut (separated) cars to a predetermined speed corresponding to the desired coupling inertia. Sometimes there is an additional downstream retarder known as a group retarder intended to further slow the car as it moves to the storage track. There may be several group retarders, one installed on each of the distribution tracks located between the hump retarder and the respective turnouts leading to the storage tracks.

The rollability of a car is hard to predict. There is no absolute assurance the trailing car will have a speed adequate, no more and no less, to couple to the one ahead. This lack of predictability is due to many factors: wind resistance; the radius of the track (this radius varies from little or none at all at the center of the classification yard to a maximum at the outer boundaries); the extent to which the car trucks are skewed; unevenness in the truck bed; and the inherent "rollability" character of the car itself, among others.

It can be seen that if the car rolls too fast against the car to which it is to be coupled, the cars as well as the lading can be damaged. If a car stalls, a locomotive must be commandered to push the stalled car, an operation known as "trimming" the yard.

The effect of variables such as those listed above become more pronounced as the distance between the retarder and the coupling point lengthens. Thus, the chances of a car stalling increase proportionally the longer a slow rolling car has to travel; likewise, the chances for damage increase proportionally the longer a fast rolling car has to travel.

The primary object of the present invention is to improve te efficiency of a railroad classification yard by diminishing the frequency of need to trim the yard and by lessening the chances of damage to the cars and the lading. Stated another way, the primary object of the present invention is to render more certain the coupling speed of railroad cars on a classification track by diminishing the distance a car travels when released from a retarder.

Another object of the present invention is to provide for the automatic or semiautomatic operation of the retarders of the present invention, thereby to minimize the operator time and attention required to assemble a block of cars on a storage track and further to insure against human error due to the inattentiveness, mistake or oversight of a busy hump man operating the yard.

A further object of the present invention is to provide control of the movement of a block of cars as it is progressed into a body track. With more particularity, it is an object to maintain the block of cars bunched together as they are progressed into the body track and further to prevent the block of cars from rolling freely downstream out of control.

Specifically, the object of the present invention is to retard a classified car as it enters the storage track, slowing the car and allowing it to drift to a second retarder, downstream, where it is stopped. This car is the lead car. Subsequent cars are similarly slowed and allowed to drift, each subsequent car coupling to the one ahead, until a block of coupled cars is collected. The downstream retarder is then released and the block of cars is pushed further down the storage track.

The drawing is a schematic view of a fragment of a railroad classification yard. Reference character 10 identifies a storage track. The cars enter the storage track one by one at a turn-out 11, having rolled to the turn-out from an upstream master or group retarder, not shown.

A first or upstream retarder 12 is installed downstream of the point if tangency where the curved portion of track meets the straight stretch of the track. This location is preferred since it is downstream of the curved track 11A of turn-out 11 which may affect te motion of a rolling car, and further because it is upstream far enough to maximize the straight length of storage track 10 available for collecting a string of cars. This retarder may be of the kind disclosed in U.S. Pat. No. 3,227,246 which applies a retarding force proporational to the weight of the car, slowing the car to a safe coupling speed, less than six mph.

A second or downstream retarder 14 is installed downstream of the first. This retarder may be of the so-called "inert" form disclosed in U.S. Pat. No. 3,621,943.

A car pusher 15 is located between the two retarders. The car pusher may be of the kind disclosed in U.S. Pat. No. 3,407,750, reciprocated hydraulically and having a one-way dog 16 engageable with the car wheel.

The retarders are separated by a distance of ten to twenty car lengths. This distance is not critical; it depends principally on the grade of the classification track and the number of cars which the pusher 15 is able to handle.

The terminal end of the storage track may be equipped with a retarder 18 serving as a stop for the cars delivered from the retarder 14. The stop device 18 may be a retarder similar to the retarder 14, separated therefrom approximately one hundred car lengths.

To provide for the automatic or semiautomatic operation of the retarders and pusher of the present invention, two presence detectors 60 and 61 may be installed along the storage track. Each presence detector is effective to sense whether or not a car is present within its respective detector zone 60Z and 61Z, being the space above a finite length of track. The drawing represents each zone 60Z and 61Z as including the length of track between the perpendicular end lines of each detector symbol.

To prevent a detector zone from being spanned by a coupled pair, it is preferred that each detector zone be at least as long as one-half car length. In other words, if the coupling between two cars is located within the detector zone, the zone is wide enough to include a portion of at least one of the car bodies. The first detector zone is interposed between the first and second retarders, preferably adjacent the downstream edge of the first retarder 12. The second detector zone is interposed between the first detector and second retarder, preferably adjacent the upstream edge of the second retarder 14.

Many types of presence detector with many different principles of operation are well known, as well as devices particularly adapted for sensing the location or some other property of the movement of a railroad car on track. For example, the presence detector may consist of a pair of railway wheel sensors of the kind disclosed in U.S. Pat. No. 3,721,821 or 3,721,859, with the sensors spaced apart longitudinally along the track according to the desired width of the detector zone. In this instance, the upstream sensor would detect the wheels of a car entering the zone and, until the downstream recorder detects the same number of wheels leaving the zone, the detector circuit can indicate that a car is present within the detector zone. Similarly, a pair of electric eyes could be installed defining the ends of a detector zone, with each unit consisting of a source of radiant energy on one side of the body track producing a beam to be picked up by a receiver or detector on the opposite side of the track. In this instance, the interruption of either beam would indicate the presence of a car. It is preferred to use a magnetic sensor which functions basically as a metal-detector. A magnetic field is created above a stretch of track approximately as long as a half car length so that changes in the magnetic field due to the presence of a mass of steel such as a railroad car may be detected to indicate the presence or absence of a car.

The foregoing describes the static condition under the present invention and of course it will be appreciated that what has been described in connection with storage track 10 will be repeated for nearly all storage tracks in the yard.

In operation, Phase 1 shown in the drawing, the cars traversing the turn-out 11 pass through retarder 12 which is actuated to slow the cars one by one in accordance with car weight or some other condition. After the necessary force has been applied to bring the car to a safe speed, the retarder is released or opened, allowing the car to move out of retarder 12. This car rolls down the storage track toward retarder 14. When the lead car 20 attains retarder 14, this retarder is activated to stop the lead car. The pusher 15 is inactive and the second presence detector 61 is down or deactivated.

Note that as each car leaves first retarder 12, it passes through the first detector zone 60Z as it drifts downstream. For this reason, presence detector 60 has a time delay, i.e., time "T", such that the detector will signal the presence of a car only if it stands in the first detector zone for a period of time longer than time "T". Time T may be preset to a time longer than the maximum time expected for a car to roll through the first detector zone, twenty seconds to one minute for example.

Each subsequent car, in sequence, transverses the turn-out 11 and passes through the retarder 12, being released therefrom to roll at a slow speed toward lead car 20 held by retarder 14. The cars couple one to another, cars 21, 22 and so on until a group of cars A, one coupled to the other has been created.

The lead car 20, Phase 1, is displaced into the retarder 14 no more than a car length so that its coupler at the rear can be engaged by the coupler of the next trailing car, car 21. It is assumed group A consists of 17 cars, an arbitrary number, car 36 being the trailing car of this block.

When the last car, identified by reference character 36, coupled with block A, it is positioned within the first detector zone 60Z and remains there longer than the predetermined time T. Hence presence detector 60 signals the presence of car 36 by a light on a master control board, for example. In response to this signal, an operator opens the downstream retarder 14 and energizes pusher 15 to advance the block of cars downstream in the direction of the stop device.

The second presence detector 61 is also on line or activated during activation of pusher 15.

The pusher is reciprocated repeatedly, Phase 2, until the cars of group A have been advanced downstream to the point where trailing car 36 clears or leaves the second detector zone 61Z. Second detector 61, sensing the presence of no car within the second detector zone, automatically reactivates the downstream retarder 14 to stop and hold a car of block A. It is preferred that the last car 36 leave the second detector zone when it is displaced no more than a car length into retarder 14 so that at least the last car will be held by retarder 14 with its coupler at the rear engageable by subsequent cars. Reactivation of retarder 14 is generally simultaneously effective to deactivate pusher 15 which in turn deactivates the second presence detector 61.

A new block of cars is created, group B, commencing with lead car 40 which couples to trailing car 36, Phase 3. Group B is shown as consisting of another block of seventeen cars terminating with trailing car 53, which remains within the first detector zone 60Z longer than the predetermined time T. Again the downstream retarder is opened thereby actuating pusher 15 and the second presence detector 61. Pusher 15 advances the string of cars consisting of blocks A and B further downstream in the direction of stop device 18 until the last car 53 clears the second presence detector zone 61Z, at which point the downstream retarder 14 is closed on a car of block B, thereby deactivating pusher 15 and presence detector 61.

The operation described above is continued until the new train has been created on storage track 10. The new train may, for example, consist only of the cars in groups A and B, it being immaterial that these cars have not been advanced all the way to stop device 18.

The sequence of operation is as follows:

activating retarder 12 to slow the entering cars, activating retarder 14 to stop and hold a lead car, accumulating cars until detector 60 indicates the presence of a last car, then generally simultaneously opening retarder 14 and activating pusher 15 and presence detector 61, detecting the passage of the last car out of the second detector zone and reactuating retarder 14 to stop and hold the last car. Thus, a continuous string of cars is assembled and progressed block by block into the body track.

As long as the basic sequence remains unchanged, it is immaterial whether the retarders and pusher are activated manually or automatically in response to signals from the presence detectors. Obviously, on a storage track equipped with no presence detectors, the retarders and pusher must be activated and deactivated manually. Likewise however, on storage tracks equipped with one or both of the presence detectors, some manual control may be desired. response Thus, in one form of the operation, the first presence detector 60 simply signals an operator, such as by turning on a light at a master control panel, when a block is complete. The operator then manually, perhaps by a single switch, opens retarder 14, and activates pusher 15 and the second presence detector 61. A signal from detector 61 that the last car has cleared the second detector zone automatically closes retarder 14 and deactivates pusher 15 and itself. In other forms of the operation, detector 61 could also be used simply to signal an operator.

In the fully automatic operation, the signal from presence detector 60 indicating that a block is complete automatically opens retarder 14 and activates pusher 15 and the second presence detector 61 with the remainder of the operation continuing automatically as in the prior example.

By classifying cars in the manner described above, the distance a car has to roll is at most the distance between the release point in retarder 12 to the stop point in retarder 14, preferably no more than five hundred feet. Only the lead car (20, 40 etc.) in each block travels this distance. On the other hand, the last car (36,53 etc.) in each block rolls the least distance. Thus, under the present invention a car is released at a predetermined slow speed from an upstream retarder located on the storage track, drifts or rolls a short distance until it is captured by the downstream retarder 14 or until it couples to the car ahead, as the case may be. When a block or group of cars has been thus coupled, the downstream retarder is opened and the pusher is activated until the trailing car is displaced into the downstream retarder, whereupon it is captured and a new block created.

To maintain control of the motion of the string of cars as it is progressed block by block into the body track, a pressure sensor may be associated with pusher 15 to sense the force required to push the block of cars downstream. Again, many types of pressure sensors are well known. A hydraulic sensor may be attached to the hydraulic circuitry of a hydraulic pusher for example. Similarly, a current sensor or piezometer may be associated with dog 16 of almost any type of pusher to indicate the force exerted by the pusher. This provides an additional safety factor in the event the string of cars tends to run away from the dog 16 of the pusher. The sensor is preset to produce a signal when the force required to push the train drops below a predetermined minimum pressure, i.e., pressure "P1". The signal automatically closes retarder 14 thereby preventing the cars from running away and also keeping the cars bunched. The sensor produces a second signal effective to open retarder 14 when the force required to push the string of cars reaches or exceeds a desired level, i.e., pressure "P2". The second signal automatically opens retarder 14 to allow the string of cars to pass downstream. This sequence would repeat until the last car was pushed clear of the second presence detector 61. The first setting P1 is determined in accordance with the minimum force required to push a single empty car and the second setting P2 may be set somewhat higher than P1 to prevent retarder 14 from being constantly opened and closed in response to only slight pressure variations.

To obviate these failure conditions sensors 60S, 61S and 71S are employed to sense the prevalence of normal operation of the two presence detectors and the pusher actuator 71. The sensors are so imposed on the retarder control 70 as to cause the latter to hold the retarder closed in a fail-safe condition in event of the failed presence detector of failed pusher actuator. The sensors, for example, may each embody a normally open switch, closed only in the event the related operating condition is normal, to allow the retarder 14 to operate normally as long as all three switches remain closed in series as in an AND gate.

If detector 60 or 61 is in a failed condition, control 70 for the retarder may receive a false signal, e.g., to open the retarder when it should remain closed. similarly, if the retarder control 70 is effective to open the retarder when it should be opened to release a block of cars, but the actuator 71 (hydraulic piston or mechanical linkage) for the pusher 15 fails to extend to operate the pusher, then a following car would tend to place the whole block in uncontrolled motion through the open retarder.

I claim:

1. A method for coupling railroad cars on a railroad storage track, wherein the track is equipped with an upstream car retarder and downstream car retarder, and wherein the track is also equipped with means to forcefully move cars toward a point downstream of the downstream retarder, comprising: operating the upstream retarder to slow the entering cars one-by-one to a predetermined speed, allowing each of the slowed cars to drift toward the downstream retarder, actuating the downstream retarder to stop and hold a lead car, maintaining the downstream retarder activated as additional cars drift toward the downstream retarder and couple themselves one to another as a block of coupled cars behind the lead car held in the downstream retarder, releasing the downstream retarder after a predetermined number of cars have been so coupled to form a block of cars, and actuating said means to propel the block of cars toward a point downstream of the second-named retarder.

2. A method for coupling railroad cars on a railroad storage track, wherein the track is equipped both with a car retarder and wherein the track is also equipped with means to forcefully move cars toward a point downstream of a retarder, comprising: actuating the retarder to stop and hold a lead car, maintaining the retarder activated as additional cars drift toward the retarder and couple themselves one to another as a block of coupled cars behind the lead car held in the retarder, releasing the retarder after a predetermined number of cars have been so coupled to form a block of cars, and actuating said means to move the block of cars out of the released retarder toward a point on the storage track downstream of the retarder.

3. A method of progressing cars in blocks into a body track, wherein the track is equipped with an upstream or first car retarder and downstream or second car retarder, comprising:

operating the first retarder to slow the entering cars to a predetermined speed, allowing each of the slowed cars to drift toward the downstream retarder, detecting the presence of each car which passes through a first detector zone interposed between the upstream retarder and downstream retarder, actuating the downstream retarder to stop and hold a lead car, maintaing the downstream retarder actuated as additional cars drift toward the downstream retarder and couple themselves one to another as a block of coupled cars behind the lead car held in the downstream retarder, detecting the presence of the last car coupled to the block and positioned within the first detector zone longer than a predetermined minimum time, and in response thereto, opening the downstream retarder and pushing the block of cars downstream of said downstream retarder while simultaneously detecting the presence of each car which passes through a second detector zone interposed between the first detector zone and downstream retarder, and in response to detecting the presence of no car within the second detector zone once the last car has exited therefrom, reactuating the downstream retarder.

4. The method of claim 3 further comprising signalling an operator in response to detecting the presence of a last car within the first detector zone and manually initiating the step of opening the downstream retarder and pushing the block of cars downstream of said downstream retarder.

5. The method of claim 3 wherein opening the downstream retarder and pushing the block of cars downstream is accomplished automatically in response to detecting the presence of a last car within the first detector zone.

6. The method of claim 3 further comprising sensing the force required for pushing the block of cars downstream of said downstream retarder and, in response to said force falling below a predetermined minimum force, actuating the downstream retarder and, in response to said force reaching or exceeding a predetermined desired force, reopening the downstream retarder.

7. The method of claim 3 wherein reactuating the downstream retarder in effective to stop and hold a car of said block and further comprising: ceasing to detect the presence of cars in the second detector zone in response to reactuating the downstream retarder.

8. The method of claim 7 wherein the first detector zone is adjacent the downstream edge of the upstream retarder and the second detector zone is adjacent the upstream edge of the downstream retarder.

9. A method of progressing cars in blocks into a body track wherein the track is equipped with a first car retarder, a second car retarder downstream of said first retarder and first and second presence detectors, comprising:

operating the first retarder to slow the entering cars to a predetermined speed activating the first presence detector to sense the presence of a car within a first detector zone generally adjacent the downstream edge of said first retarder, allowing each of the slowed cars to drift downstream toward the second retarder, actuating the second retarder to stop and hold a lead car, maintaining the second retarder actuated as additional cars drift toward the second retarder and couple themselves one to another as a block of coupled cars behind the lead car held in the second retarder, opening the second retarder and pushing the block of cars downstream of the second retarder in response to a signal from the first presence detector that a car has remained within the first detector zone longer than a predetermined minimum time, activating the second presence detector to sense the presence of a car in a second detector zone generally adjacent the upstream edge of the second retarder and, in response to a second detector signal indicating the presence of no car within the second detector zone, reactivating the second retarder to stop and hold a car of the block.

10. The method of claim 9 wherein activating the second presence detector is done in response to pushing the block of cars downstream of the second retarder and further comprising deactivating the second presence detector in response to reactivating the second retarder.

11. An apparatus for progressing cars in blocks into a body track comprising in combination:

a first retarder for slowing the entering cars to a predetermined speed, a second retarder spaced downstream from said first retarder for stopping with holding a lead car and subsequent cars coupled thereto to form a block of cars, a first presence detector for sensing the presence of each car within a first detector zone interposed between the first and second retarders, said detector producing a signal effective to initiate opening of said second retarder upon detection of a car within the zone longer than a predetermined minimum time, a car pusher activated in response to the opening of the second retarder and effective to force the block of cars downstream of the second retarder, and a second presence detector sensing the presence of cars within a second detector zone interposed between the first detector zone and second retarder, said second presence detector being on line during activation of the car pusher and producing a signal effective to deactivate the car pusher and initiate closing of the second retarder upon detection of no car within the second detector zone.

12. The apparatus of claim 11 further comprising a pressure sensor associated with the pusher for detecting the force required to push a block of cars, and pressure sensor being effective to close said second retarder in response to a drop in force below a predetermined minimum and effective to open said second retarder in response to a force reaching or exceeding a predetermined desired force.

13. The apparatus of claim 11 including means to detect a failed condition of at least one of the presence detectors and to hold the second retarder actuated in the event of such condition.

14. The apparatus of claim 13 including means to detect failure of the car pusher to be activated and to hold the second retarder actuated in the event of such failure.

* * * * *